US008840217B2

(12) United States Patent
Yamagata

(10) Patent No.: US 8,840,217 B2
(45) Date of Patent: Sep. 23, 2014

(54) SHEET SUPPLY DEVICE

(71) Applicant: Riso Kagaku Corporation, Tokyo (JP)

(72) Inventor: Akihiro Yamagata, Ibaraki-ken (JP)

(73) Assignee: Riso Kagaku Corporation, Tokyo (JP)

( * ) Notice: Subject to any disclaimer, the term of this patent is extended or adjusted under 35 U.S.C. 154(b) by 0 days.

(21) Appl. No.: 13/916,003

(22) Filed: Jun. 12, 2013

(65) Prior Publication Data

US 2013/0342602 A1 Dec. 26, 2013

(30) Foreign Application Priority Data

Jun. 22, 2012 (JP) ..... 2012-140602

(51) Int. Cl.
*B41J 29/38* (2006.01)
*B65H 3/02* (2006.01)
*B41J 13/26* (2006.01)

(52) U.S. Cl.
CPC .. *B41J 13/26* (2013.01); *B65H 3/02* (2013.01)
USPC ..... 347/16

(58) Field of Classification Search
CPC ..... B41J 11/42; B41J 13/0009; B41J 13/26; B41J 13/0018; B41J 13/0027
USPC ..... 347/16, 101, 104; 271/10.11
See application file for complete search history.

(56) References Cited

U.S. PATENT DOCUMENTS 5,482,265 A * 1/1996 Nakazato et al. ..... 271/242

FOREIGN PATENT DOCUMENTS

JP 2010-215389 9/2010

* cited by examiner

*Primary Examiner* — An Do
(74) *Attorney, Agent, or Firm* — Hamre, Schumann, Mueller & Larson P.C.

(57) ABSTRACT

A sheet supply device includes registration rollers for feeding a print sheet, a sheet supply roller for feeding a print sheet to the registration rollers, and a controller configured to control the registration rollers and the sheet supply roller. The controller is operable to start first rotation of the sheet supply roller to contact a leading edge of the print sheet to a nip between the registration rollers to form a slack of the print sheet, stop the first rotation after the slack is formed, start rotation of the registration rollers after the first rotation is stopped, start second rotation of the sheet supply roller after the rotation of the registration rollers is started, and keep a speed difference between a feed speed of the registration rollers and a feed speed of the sheet supply rollers until the slack is flattened. According to the device, noises can be reduced.

3 Claims, 5 Drawing Sheets

SHEET SUPPLY DEVICE

BACKGROUND OF THE INVENTION

1. Technical Field

The present invention relates to a sheet supply device for supplying print sheets (print media).

2. Background Arts

Conventionally, known is a sheet supply device that picks up a print sheet from a sheet supply tray and feeds the print sheet to a print unit by its registration rollers. In the sheet supply device, the print sheet is stalled in a state where its leading edge is contacted to a registration nip between the registration rollers to form a slack in the print sheet, so that an oblique feed of the print sheet can be compensated. Then, the registration rollers are driven to feed the print sheet to the print unit.

When the print sheet is fed forward by the registration rollers, the slack of the print sheet is expanded (i.e. back tension is applied to the print sheet) between the registration nip of the registration rollers and rollers located upstream from them. As a result, a noise (sheet expansion noise) may be generated due to the expansion of the slack.

A Japanese Patent Application Laid-Open No. 2010-215389 (Patent Document 1) discloses a sheet supply mechanism that also carries out an assistant operation. In the assistant operation, rollers located upstream from registration rollers are driven while the registration rollers are being driven.

In the sheet supply mechanism, when supplying a print sheet form a sheet supply side tray, the print sheet is picked up by primary sheet supply rollers from the sheet supply side tray, and then stalled in a state where its leading edge is contacted to a registration nip between registration rollers to form a slack in the print sheet. From the state, the assistant operation is carried out by starting to drive the primary sheet supply rollers at the same time as starting to drive the registration rollers.

Specifically, the primary sheet supply rollers and the registration rollers are started to be driven at the same time, and an acceleration of a feed speed applied to the print sheet by the primary sheet supply rollers is made smaller than that applied to the print sheet by the registration rollers. Therefore, a difference between the feed speed by the registration rollers and that by the primary sheet supply rollers increases gradually. As a result, the slack of the print sheet is flattened gradually. After the slack of the print sheet has been flattened, the primary sheet supply rollers are stopped to finish the assistant operation. Since main function of the primary sheet supply rollers is to pick up a print sheet and feed forward the picked-up print sheet, the assistant operation is finished (the primary sheet supply rollers are stopped) before a trailing edge of the picked-up print sheet passes completely through the primary sheet supply rollers in order to prevent the primary sheet supply rollers from picking up the next print sheet erroneously.

By the above-explained assistant operation in the sheet supply mechanism of the Patent Document 1, a back tension applied to the print sheet by expanding the slack of the print sheet is reduced by gradually flattening the slack of the print sheet, compared with a mechanism that carries out no assistant operation.

SUMMARY OF THE INVENTION

However, the difference between the feed speed of the registration rollers and that of the primary sheet supply rollers is gradually increased in the assistant operation of the Patent Document 1, as explained above. The larger the difference when flattening the slack of the print sheet is, the larger the back tension applied to the print sheet becomes. Therefore, the back tension applied to the print sheet may become large in the sheet supply device of the Patent Document 1. Namely, its reduction effect of the sheet expansion noise is not sufficient.

An object of the present invention is to provide a sheet supply device that can reduce noises.

An aspect of the present invention provides a sheet supply device that includes a pair of registration rollers for feeding a print sheet to a print unit of a printer; a sheet supply roller for feeding a print sheet to the pair of registration rollers; and a controller configured to control the pair of registration rollers and the sheet supply roller, wherein the controller is operable to: start first rotation of the sheet supply roller to contact a leading edge of the print sheet to a registration nip of the pair of registration rollers to form a slack of the print sheet, stop the first rotation of the sheet supply roller after the slack of the print sheet is formed, start rotation of the pair of registration rollers after the first rotation of the sheet supply roller is stopped, start second rotation of the sheet supply roller after the rotation of the pair of registration rollers is started, and keep a speed difference between a feed speed of the pair of registration rollers and a feed speed of the sheet supply rollers until the slack of the print sheet is flattened.

According to the aspect, the controller controls the pair of registration rollers and the sheet supply roller to start second rotation of the sheet supply roller after the rotation of the pair of registration rollers is started, and keep a speed difference between a feed speed of the pair of registration rollers and a feed speed of the sheet supply rollers until the slack of the print sheet is flattened. Therefore, the speed difference at the time when the slack of the print sheet is flattened is prevented from increasing, so that a sheet expansion noise due to back tension can be restricted.

It is preferable that the controller is operable to keep the feed speed of the pair of registration rollers constant for a predetermined time period after the slack of the print sheet is flattened, and start to reduce the feed speed of the pair of registration rollers after the predetermined time period elapses.

According to this configuration, reduced can be a noise generated at a start of reducing the feed speed of the sheet supply roller due to cancellation of a backrush of gears in a drive force transmitting system that transmits a drive force to the sheet supply roller.

DESCRIPTION OF THE EMBODIMENTS

Figure 1:
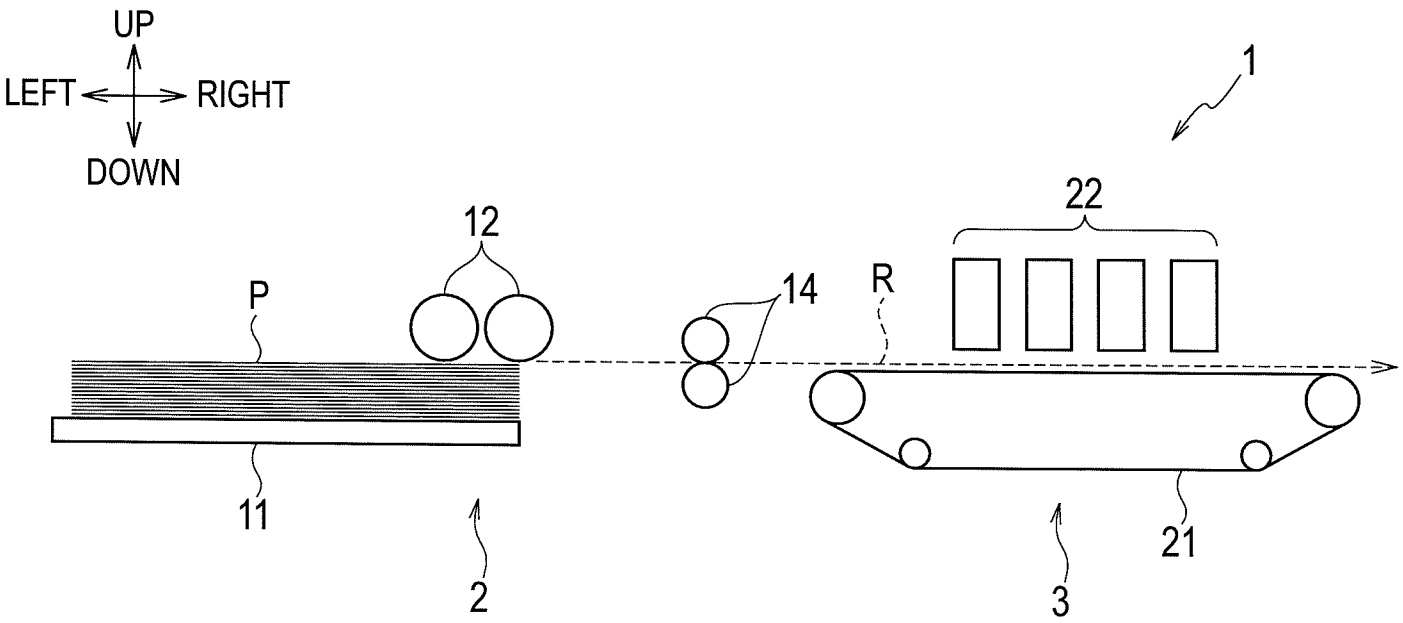
FIG. 1 is a schematic configurational diagram of a printer that includes a sheet supply device according to an embodiment.

Hereinafter, an embodiment will be explained with reference to the drawings. In the drawings, an identical or equivalent component is indicated by an identical reference number. But, the drawings show components schematically, and it should be considered that they are not shown in the drawings precisely as they are. In addition, dimensions of the components and dimensional proportions between the components may be shown differently in the drawings.

Further, the embodiment described below is explained as an example that specifically carries out the subject matter of the present invention, and the subject matter of the present invention is not limited to the embodiment. The embodiment may be modified within the scope of the claims (e.g. arrangement of components may be changed from the embodiment).

Figure 2:
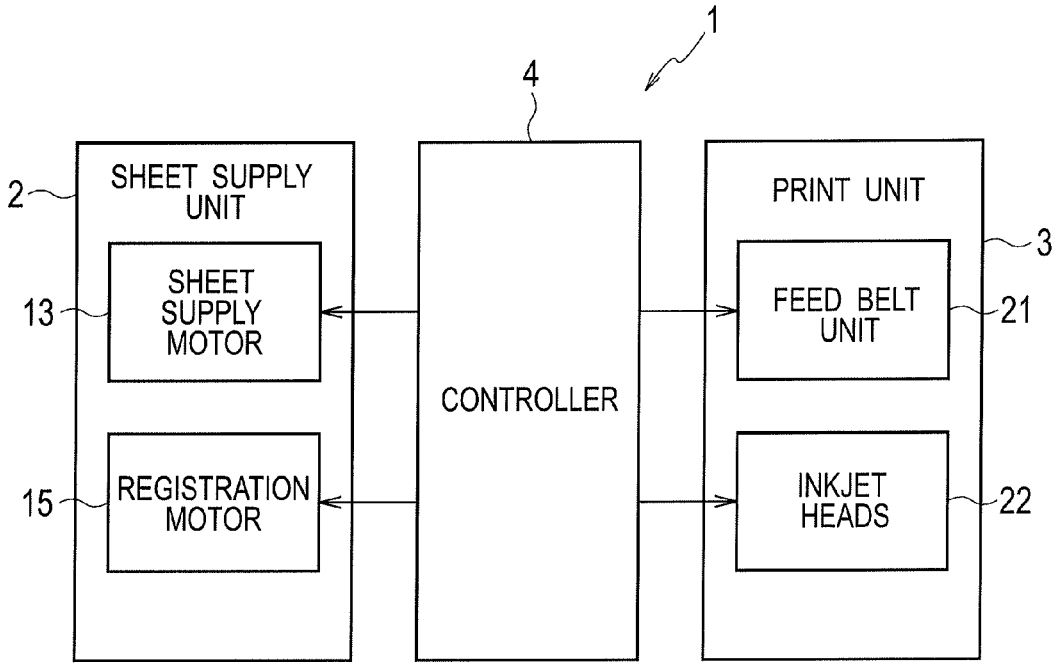
FIG. 2 is a block diagram showing a control system of the printer.

FIG. 1 shows a schematic configuration of a printer 1 that includes a sheet supply device according to an embodiment, and FIG. 2 shows a block diagram showing a control system of the printer. In the following descriptions, upward, downward, leftward and rightward are defined as shown by arrows shown in FIG. 1. In addition, a path shown by a dotted line in FIG. 1 is a feed path along which a print sheet(s) P as a print medium (media) is fed from left to right. Further, in the following descriptions, upstream and downstream is used in relation to the feed path.

As shown in FIGS. 1 and 2, the printer 1 includes a sheet supply unit 2, a print unit 3, and, a controller 4. Note that the sheet supply device is configured of the sheet supply unit 2 and the controller 4.

The sheet supply unit 2 supplies a print sheet(s) P to the print unit 3. The sheet supply unit 2 includes a sheet tray 11, a pair of sheet supply rollers 12, a sheet supply motor 13, a pair of registration rollers 14, and a registration motor 15.

On the sheet tray 11, print sheets P as print media are stacked.

The sheet supply rollers 12 pick up the print sheets P stacked on the sheet tray 11 sheet by sheet, and then sequentially feed them to the registration rollers 14. The sheet supply rollers 12 are disposed above the sheet tray 11.

The sheet supply motor 13 drives the sheet supply rollers 12 to rotate them.

The registration rollers 14 stall a print sheet P fed by the sheet supply rollers 12 in a state where a leading edge of the print sheet P is contacted to a registration nip between the registration rollers 14, and then feed the print sheet P to the print unit 3 after a slack of the print sheet P is formed.

The registration rollers 14 are disposed downstream from the sheet supply rollers 12.

The print unit 3 prints on a print sheet P while feeding the print sheet P. The print unit 3 is disposed downstream from the sheet supply unit 2. The print unit 3 includes a feed belt unit 21, and inkjet heads 22.

The feed belt unit 21 feeds a print sheet P that has been fed from the registration rollers 14 while holding it thereon by suctioning. Therefore, the feed belt unit 21 also includes a suction unit (not shown) for suctioning a print sheet P onto its continuous loop belt (feed belt) wound around rollers. The rollers are driven by a belt motor (not show) to circulate the feed belt, and thereby the print sheet P on the feed belt is fed forward.

The inkjet heads 22 are line-type inkjet heads each includes nozzles aligned along a direction (front-back direction) almost perpendicular to a feed direction of a print sheet P. The inkjet heads 22 are disposed above the feed belt unit 21. The inkjet heads 22 print images on a print sheet P fed by the feed belt unit 21 by injecting ink droplets onto the print sheet P.

The controller 4 controls operations of components in the printer 1. The controller 4 is configured to include a CPU, a RAM, a ROM and so on.

Specifically, the controller 4 executes printing on a print sheet(s) P by controlling the sheet supply unit 2 to supply the print sheet P to the print unit 3, controlling the feed belt unit 21 to feed the print sheet P, and controlling the inkjet heads 22 to inject ink droplets on the print sheet.

In a sheet supply operation by the sheet supply unit 2, the controller 4 drives the sheet supply rollers 12 to supply a print sheet P from the sheet tray 11, and then stops them when a leading edge of the print sheet P is contacted to the registration nip between the registration rollers 14 to form a slack with a given slack amount. After stopping the sheet supply rollers 12, the controller 4 starts to drive the registration rollers 14. While driving the registration rollers 14, the controller 4 carries out the assistant operation in which the sheet supply rollers 12 assist the registration rollers 14. In the assistant operation, the controller 4 starts to drive the sheet supply rollers 12 after starting to drive the registration rollers 14, and keeps a speed difference between a feed speed of the registration rollers 14 and a feed speed of the sheet supply rollers 12 constant until the slack of the print sheet is flattened.

Next, operations of the printer 1 will be explained.

Figure 3:
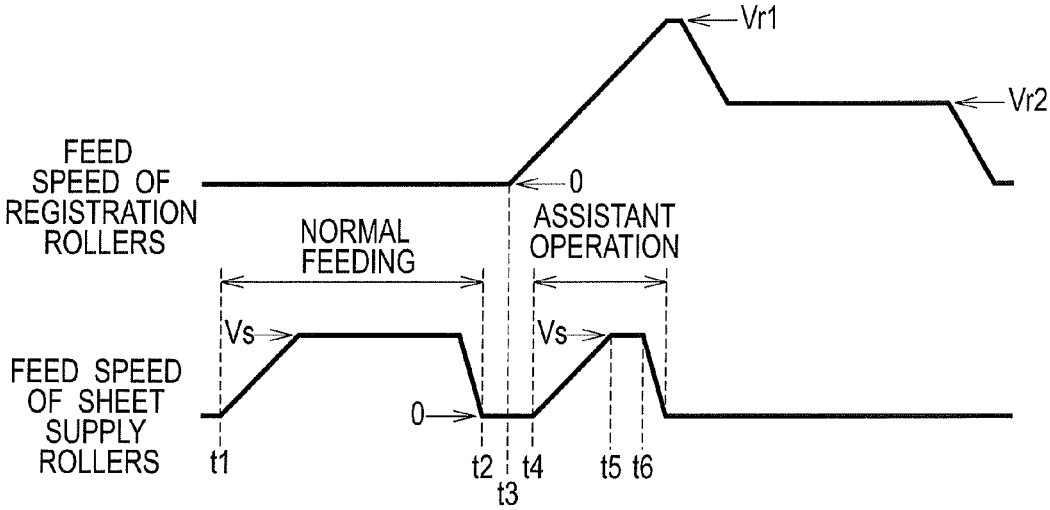
FIG. 3 is a timing chart showing changes of speeds of sheet supply rollers and registration rollers.

FIG. 3 is a timing chart showing changes of the feed speeds of the sheet supply rollers 12 and the registration rollers 14. In FIG. 3, an upper line indicates the change of the feed speed of the registration rollers 14, and a lower line indicates the change of the feed speed of the sheet supply rollers 12.

At a time t1 of a drive start timing of the sheet supply rollers 12, the controller 4 controls the sheet supply motor 13 to start rotations of the sheet supply rollers 12. By this operation, a print sheet P on the sheet tray 11 is picked up by the sheet supply rollers 12, and then fed toward the registration rollers 14.

During a printing operation, the controller 4 circularly drives the feed belt of the feed belt unit 21. The controller 4 drives the feed belt unit 21 so as to feed the print sheet P at a print feed speed Vg.

When the feed speed of the sheet supply rollers 12 reaches a preset feed speed Vs after starting the rotation of the sheet supply rollers 12, the controller 4 keeps the feed speed Vs. Then, the controller 4 reduces the feed speed of the sheet supply rollers 12 by controlling the sheet supply motor 13 to stop the sheet supply rollers 12. During a normal feeding in a time period from the time t1 when the rotation of the sheet supply rollers 12 is started to a time t2 when the rotation is stopped, a leading edge of the print sheet P is contacted to the registration nip between the registration rollers 14, and then a slack of the print sheet P with a given slack amount is formed.

After stopping the sheet supply rollers 21, the controller 4 starts rotation of the registration rollers 14 by controlling the registration motor 15. After the rotation of the registration rollers 14 are started, the controller 4 accelerates the feed speed of the registration rollers 14 with an acceleration $\alpha$. When the feed speed of the registration rollers 14 reaches a given feed speed Vr1, the controller 4 keeps the feed speed Vr1 for a predetermined time period. Then, the controller 4 reduces the feed speed of the registration rollers 14 to a feed speed Vr2 (see FIG. 3) by controlling the registration motor 15. The feed speed Vr2 is almost equal to the above-explained printing feed speed Vg. The controller 4 reduces the feed speed of the registration rollers 14 to the feed speed Vr2 before the leading edge of the print sheet P reaches the feed belt unit 21.

Subsequently, at a time when a trailing edge of the print sheet passes through the registration nip between the registration rollers 14, the controller 4 stops the rotation of the registration rollers 14 by stopping the registration motor 15.

In addition, after starting the rotation of the registration rollers 14, the controller 4 starts a rotation of the sheet supply rollers 12 at a time t4 by controlling the sheet supply motor 13 in order to carry out the assistant operation. After starting the rotation of the sheet supply rollers 12, the controller 4 accelerates the feed speed of the sheet supply rollers 12 with the acceleration α that is identical to the acceleration α applied to the registration rollers 14.

When the feed speed of the sheet supply rollers 12 reaches the feed speed Vs (at a time t5), the controller 4 keeps the feed speed Vs for a predetermined time period. During the time period from the time t3 to the time t5, the slack of the print sheet P is gradually flattened due to the difference between the feed speed of the registration rollers 14 and the feed speed of the sheet supply rollers 12. A start timing (time t4) of the assistant operation is determined so that the slack of the print sheet P is to be flattened at the time t5 when the feed speed of the sheet supply rollers 12 reaches the feed speed Vs. A method for determining the start timing (time t4) of the assistant operation will be explained later.

Subsequently, the controller 4 starts to reduce the feed speed of the sheet supply rollers 12 at a time t6 by controlling the sheet supply motor 13 to stop the rotation of the sheet supply rollers 12. The controller 4 stops the sheet supply motor 13 to finish the assistant operation before the trailing edge of the print sheet P passes through the sheet supply rollers 12 in order to prevent the sheet supply rollers 12 from erroneously picking up and feeding the next print sheet P.

When the print sheet P is fed from the registration rollers 14 to the feed belt unit 21, the controller 4 controls the inkjet heads 22 to inject ink droplets onto the print sheet P. As a result, images are printed on the print sheet P.

Next, the method for determining the start timing (time t4) of the assistant operation will be explained hereinafter.

As explained above, the acceleration of the feed speed of the sheet supply rollers 12 is made equal to the acceleration α of the feed speed of the registration rollers 14 in the assistant operation until the time t5 when the feed speed of the sheet supply rollers 12 reaches Vs. The time t4 that is the start timing of the assistant operation by the sheet supply rollers 12 is determined so that the slack of the print sheet P is to be flattened at the time t5. Namely, the time t4 is determined so that a difference ΔL between a feed amount by the registration rollers 14 during the time period t3 to t5 and a feed amount by the sheet supply rollers 12 during the time period t4 to t5 becomes equal to a slack amount Lt of the print sheet P.

Figure 4:
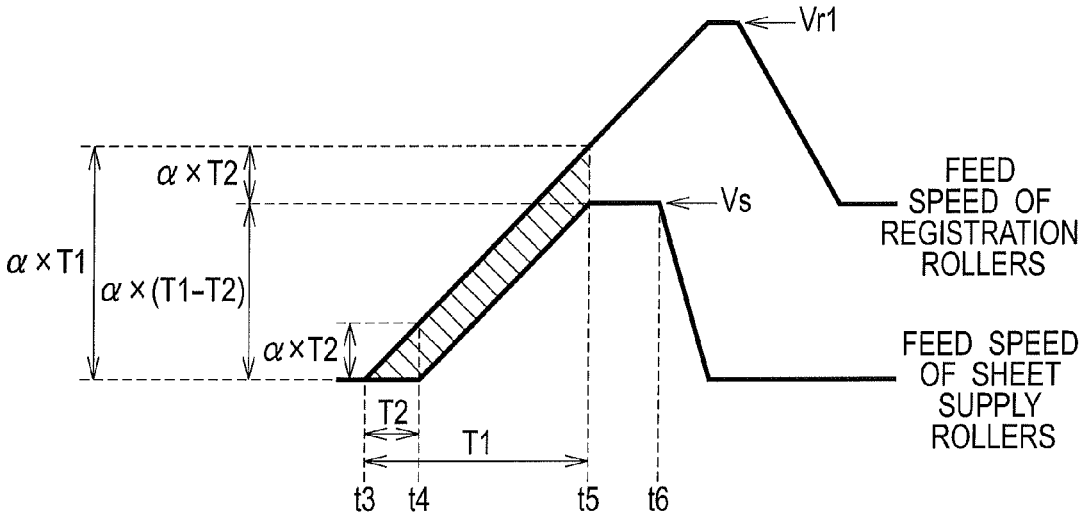
FIG. 4 is a timing chart explaining a start timing of an assistance operation by the sheet supply rollers.

The difference ΔL corresponds to an area indicated by hatched lines in FIG. 4. As shown in FIG. 4, the time period t3 to t5 is defined as T1 and the time period t3 to t4 is defined as T2. Therefore, the feed speed of the registration rollers 14 at the time t5 is α×T1. In addition, the feed speed of the sheet supply rollers 12 at the time t5 is α×(T1−T2). Since the difference ΔL is equal to the slack amount Lt, a following equation (1) is satisfied.

$$Lt=\{T1\times(\alpha\times T1)/2\}-\{(T1-T2)\times[\alpha\times(T1-T2)]/2\} \quad (1)$$

In addition, since the feed speed of the sheet supply rollers 12 at the time t5 is Vs as explained above, a following equation (2) is satisfied.

$$\alpha\times(T1-T2)=Vs \quad (2)$$

The above equations (1) and (2) lead to a following equation (3).

$$\{[\alpha\times(T2\hat{}2)]/2\}+(Vs\times T2)-Lt=0 \quad (3)$$

T2 (i.e. the time t4) can be sought from the above equation (3). Note that the acceleration α, the feed speed Vs and the slack amount Lt are given (predetermined) values.

The time t4 is determined, as the start timing of the assistant operation by the sheet supply rollers 12, by adding T2 sought from the above equation (3) to the time t3 when the rotation of the registration rollers 14 are started.

Figure 5:
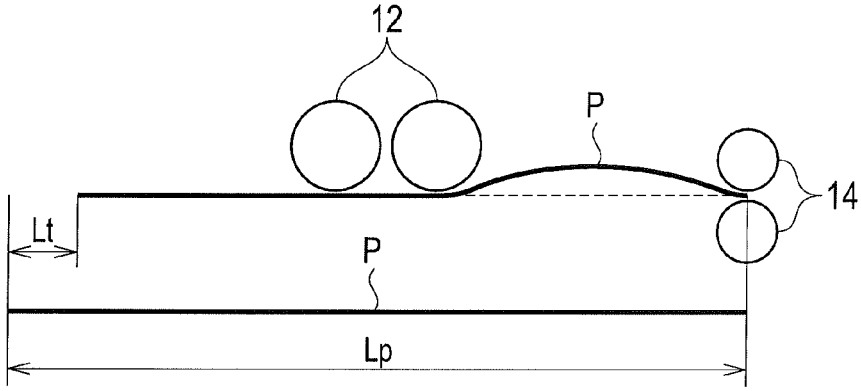
FIG. 5 is a side view for explaining a slack amount.

As shown in FIG. 5, the slack amount Lt corresponds to a shortened length, relative to an original length Lp of the print sheet P, when the print sheet P is contacted to the registration nip between the registration rollers 14 to form the slack with an amount appropriate for compensation of an oblique feed of the print sheet P. The slack amount Lt is set according to a type of the print sheet P and so on.

Figure 6:
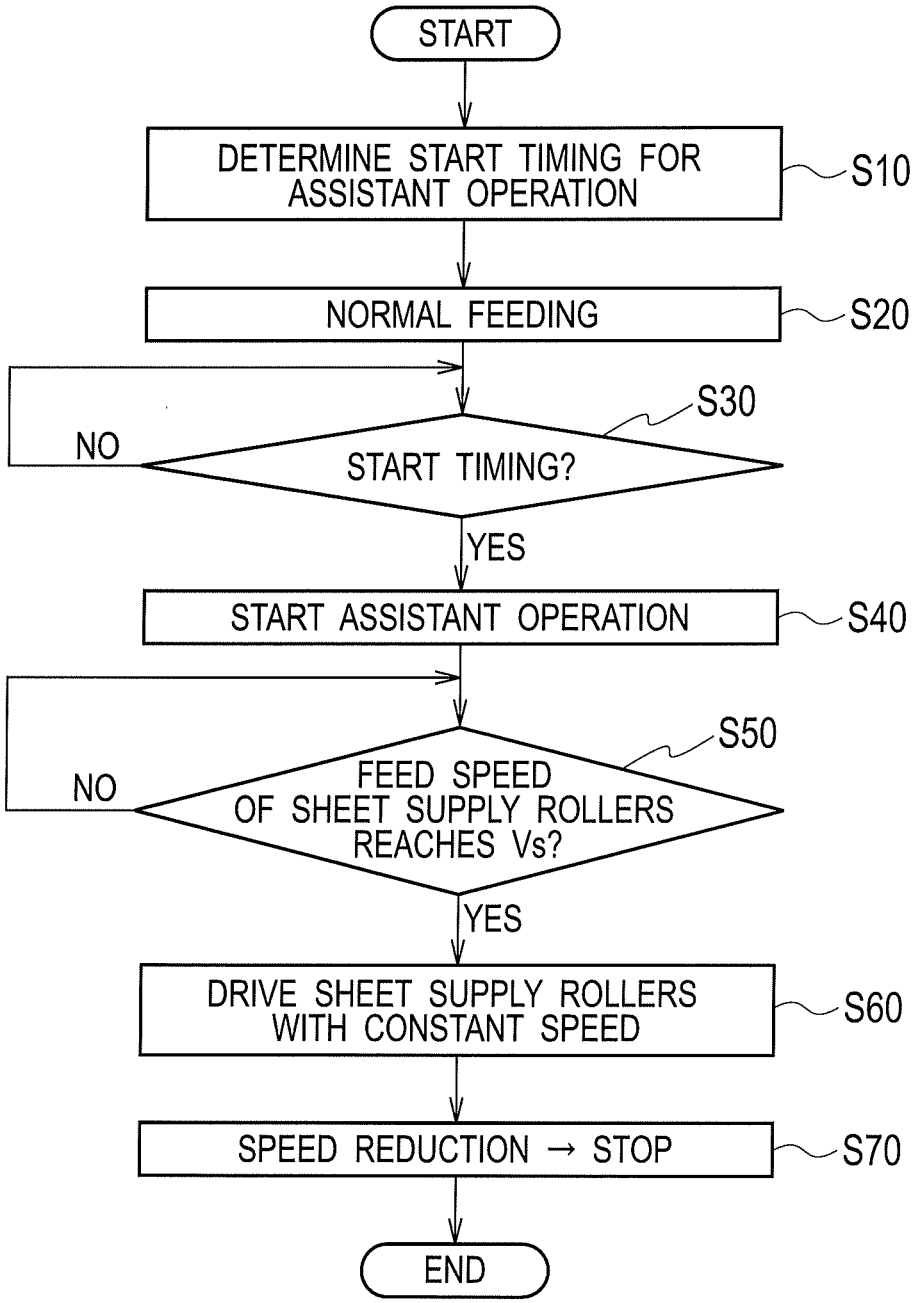
FIG. 6 is a flowchart for explaining a control of the sheet supply rollers.

Next, control processes for the assistant operation by the sheet supply rollers 12 will be explained with reference to a flowchart shown in FIG. 6. For example, the processes shown in FIG. 6 are started at a time when the printer 1 receives print data from a personal computer.

The controller 4 determines the start timing (time t4) of the assistant operation by the sheet supply rollers 12 (step S10). Specifically, the controller 4 seeks T2 based on the above equation (3), and determines the start timing (time t4) by adding T2 to the time t3 when the rotation of the registration rollers 14 is started.

Subsequently, the controller 4 controls the sheet supply rollers 12 to operate the normal feeding (step S20). By the normal feeding, a print sheet P on the sheet tray 11 is picked up and then fed toward the registration rollers 14. A leading edge of the print sheet P is contacted to the registration nip between the registration rollers 14 to form a slack with a slack amount Lt. Then, the controller 4 starts rotation of the registration rollers 14.

Subsequently, the controller 4 judges whether or not it gets to the start timing of the assistant operation determined in step S10 (step S30). If it is judged that it does not yet get to the start timing of the assistant operation (No in step S30), the controller 4 repeats the process of the step S30.

If it is judged that it gets to the start timing of the assistant operation (Yes in step S30), the controller 4 starts the assistant operation by the sheet supply rollers 12 (step S40). Specifically, the controller 4 starts the rotation of the sheet supply rollers 12 by controlling the sheet supply motor 13 to accelerate the feed speed of the sheet supply rollers 12 with the acceleration α equal to the acceleration of the feed speed of the registration rollers 14.

Subsequently, the controller 4 judges whether or not the feed speed of the sheet supply rollers 12 reaches Vs (step S50). If it is judged that the feed speed of the sheet supply rollers 12 doesn't reach Vs (No in step S50), the controller 4 repeats the process of the step S50.

If it is judged that the feed speed of the sheet supply rollers 12 reaches Vs (Yes in step S50), the controller 4, by controlling the sheet supply motor 13, stops accelerating the feed speed of the sheet supply rollers 12 at the time t5 when the feed speed of the sheet supply rollers 12 reaches Vs, and then drives the sheet supply rollers 12 at the constant feed speed Vs for a given time period (step S60).

Then, the controller 4 starts to reduce the feed speed of the sheet supply rollers 12 from the feed speed Vs by controlling the sheet supply motor 13 to stop the sheet supply rollers 12 (step S70). By the process of step S70, the sheet supply rollers 12 are stopped, so that the assistant operation is finished. Here, a start timing (time t6) for reducing the feed speed of the sheet supply rollers 12 is determined based on a size of the print sheet P and so on so as to stop the sheet supply rollers 12 before the trailing edge of the print sheet P passes through the sheet supply rollers 12.

Note that the sheet supply rollers 12 are passively rotated along with the feed speed of the print sheet P fed by the registration rollers 14 after the slack of the print sheet p is flattened.

According to the above-explained assistant operation, a speed difference ΔV between the feed speed of the registration rollers 14 and the feed speed of the sheet supply rollers 12 is made constant. Specifically, the speed difference ΔV=α×T2 at the time t4 is kept until the time t5 (see FIG. 4).

In the conventional assistant operation disclosed in the Patent Document 1, the sheet supply rollers 12 and the registration rollers 14 are started to be driven at the same time, and the acceleration of the feed speed of the sheet supply rollers 12 is made smaller than the acceleration of the feed speed of the registration rollers 14. Changes of the feed speeds of the rollers 12 and 14 and a change of a slack amount of the print sheet P by this conventional assistant operation are shown in FIG. 7.

Figure 7:
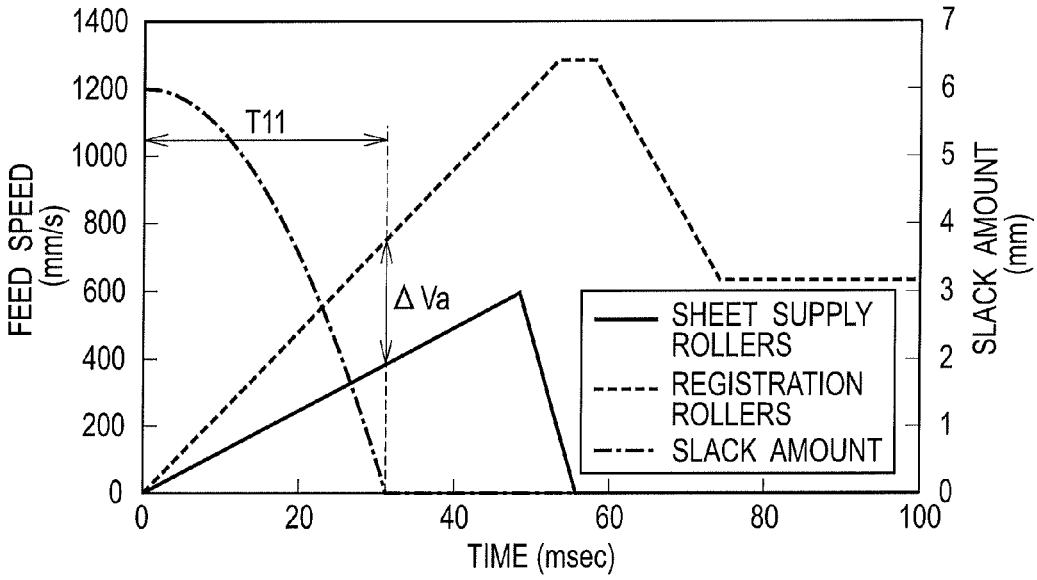
FIG. 7 is a timing chart showing an example of changes of feed speeds of sheet supply rollers and registration rollers and a change of a slack amount of a sheet in a conventional sheet supply device.

As shown by FIG. 7, the acceleration α of the feed speed of the registration rollers 14 is 25000 mm/(s^2), and the acceleration α/2 of the feed speed of the sheet supply rollers 12 is 12500 mm/(s^2). In addition, the slack mount Lt of the print sheet P at a time to start the rotation of the registration rollers 14 is 6 mm.

A time period from a time when the rotations of the sheet supply rollers 12 and the registration rollers 14 are started to a time when the slack of the print sheet P is flattened is defined as T11. The following equation (4) is satisfied.

$$Lt=\{[\alpha\times(T11\hat{}2)]/2\}-\{[(\alpha/2)\times(T11\hat{}2)]/2\} \quad (4)$$

In addition, a speed difference ΔVa between the feed speed of the registration rollers 14 and the feed speed of the sheet supply rollers 12 at a time when the slack is flattened can be sought by the following equation (5).

$$\Delta Va=(\alpha\times T11)-[(\alpha/2)\times T11] \quad (5)$$

Therefore, when α=25000 [mm/(s^2)] and Lt=6 [mm], the equations (4) and (5) lead to T11=0.031 [s] and ΔVa=387 [mm/s].

Figure 8:
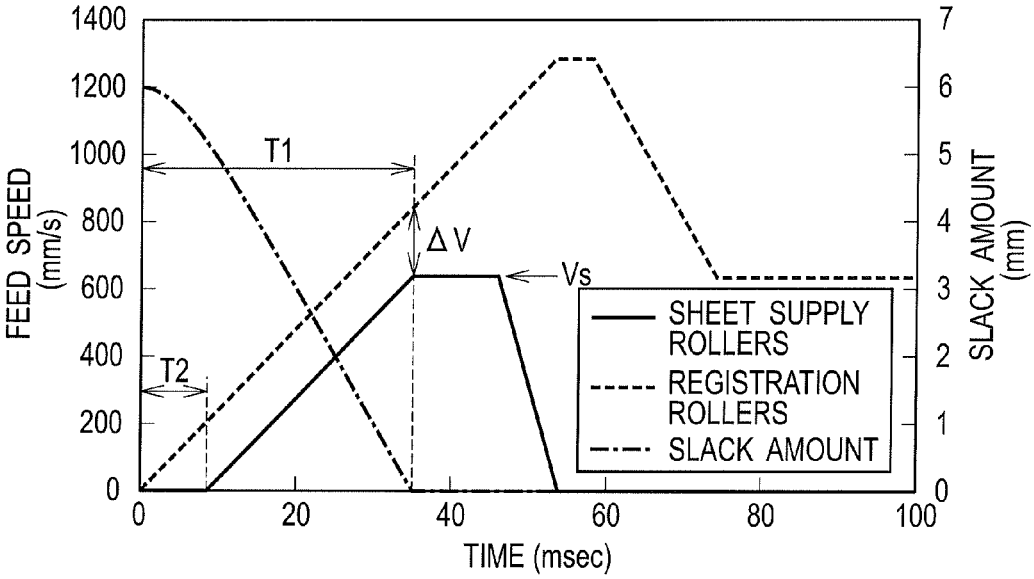
FIG. 8 is a timing chart showing an example of changes of feed speeds of the sheet supply rollers and the registration rollers and a change of the slack amount of a sheet in the embodiment.

On the other hand, changes of the feed speeds of the rollers 12 and 14 and a change of a slack amount of the print sheet P by the present embodiment are shown in FIG. 8. The acceleration α of the feed speed of the registration rollers 14 and the sheet supply rollers 12 is 25000 mm/(s^2), and the slack mount Lt of the print sheet P at a time to start the rotation of the registration rollers 14 is 6 mm, similarly to the above-explained conventional assistant operation. In addition, the feed speed Vs by the sheet supply rollers 12 at a time when the slack is flattened is 650 mm/s.

When α=25000 [mm/(s^2)], Lt=6 [mm] and Vs=650 [mm/s], the above-explained equations (1) and (2) lead to T1=0.034 [s] and T2=0.008 [s]. In addition, the speed difference ΔV between the feed speed of the registration rollers 14 and the feed speed of the sheet supply rollers 12 is kept constant until the slack is flattened, and ΔV=α×T2=200 [mm/s].

In the conventional assistant operation (FIG. 7), the speed difference ΔV is gradually increases, and it becomes ΔVa=387 [m/s] when the slack of the print sheet P is flattened. On the other hand, in the assistant operation by the present embodiment (FIG. 8), the speed differences ΔV is kept constant at 200 [m/s] until the slack of the print sheet P is flattened.

The larger the speed difference ΔV at a time when the slack of the print sheet P is flattened becomes, the larger a sheet expansion noise (noise made by flattening [expanding] the print sheet P) generated at the time may be. Therefore, the assistant operation by the present embodiment can make the sheet expansion noise due to back tension smaller than the conventional assistant operation.

As explained above, in the printer 1 according to the present embodiment, the rotation of the sheet supply rollers 12 is started after the rotation of the registration rollers 14 is started, and the speed difference ΔV between the feed speed of the registration rollers 14 and the feed speed of the sheet supply rollers 12 is kept constant until the slack of the print sheet P is flattened. Therefore, the speed difference ΔV at the time when the slack of the print sheet P is flattened is prevented from increasing, so that the sheet expansion noise due to back tension can be restricted.

Here, the acceleration of the feed speed of the sheet supply rollers 12 for the conventional assistant operation (FIG. 7) and the drive start timing of the sheet supply rollers 12 may vary according to conditions such as a slack amount Lt. Under a condition with a general slack amount Lt, the speed difference ΔV at the time when the slack of the print sheet P is flattened can be reduced by the assistant operation according to the present embodiment, compared with the conventional assistant operation.

In addition, in the printer 1, the feed speed of the sheet supply rollers 12 is temporarily kept constant after the slack of the print sheet P is flattened as shown by a time period t5 to t6 in FIGS. 3 and 4, and then the feed speed of the sheet supply rollers 12 is started to be reduced. By providing the constant speed period, reduced can be a noise generated at a start of reducing the feed speed of the sheet supply rollers 12 due to cancellation of a backrush of gears in a drive force transmitting system that transmits a drive force from the sheet supply motor 13 to the sheet supply rollers 12.

Note that the printer 1 is an inkjet type printer in the present embodiment. However, a printer including a sheet supply device according to the present invention is not limited to this printer type.

The present invention is not limited to the above-mentioned embodiment, and it is possible to embody the present invention by modifying its components in a range that does not depart from the scope thereof. Further, it is possible to form various kinds of inventions by appropriately combining a plurality of components disclosed in the above-mentioned embodiment. For example, it may be possible to omit several components from all of the components shown in the above-mentioned embodiment.

The present application claims the benefit of a priority under 35 U.S.C §119 to Japanese Patent Application No. 2012-140602, filed on Jun. 22, 2012, the entire content of which is incorporated herein by reference.

What is claimed is:

1. A sheet supply device comprising:

a pair of registration rollers for feeding a print sheet to a print unit of a printer;

a sheet supply roller for feeding a print sheet to the pair of registration rollers; and a controller configured to control the pair of registration rollers and the sheet supply roller, wherein the controller is operable to:

start driving operation of first rotation of the sheet supply roller to contact a leading edge of the print sheet to a registration nip of the pair of registration rollers to form a slack of the print sheet, stop the driving operation of the first rotation of the sheet supply roller after the slack of the print sheet is formed, start driving operation of rotation of the pair of registration rollers after the driving operation of the first rotation of the sheet supply roller is stopped, start driving operation of second rotation of the sheet supply roller after the driving operation of the rotation of the pair of registration rollers is started, and keep a speed difference between a feed speed of the pair of registration rollers and a feed speed of the sheet supply roller until the slack of the print sheet is flattened.

2. The sheet supply device according to claim 1, wherein the controller is operable to keep the feed speed of the pair of registration rollers constant for a predetermined time period after the slack of the print sheet is flattened, and start to reduce the feed speed of the pair of registration rollers after the predetermined time period elapses.

3. The sheet supply device according to claim 1, wherein the controller is operable to the start driving operation of the second rotation of the sheet supply roller after a predetermined time period that is subsequent to the start driving operation of rotation of the pair of registration rollers elapses.

* * * * *